US011530566B2

(12) United States Patent
Van De Wiel et al.

(10) Patent No.: US 11,530,566 B2
(45) Date of Patent: Dec. 20, 2022

(54) DOOR OPERATOR SYSTEM

(71) Applicant: ASSA ABLOY ENTRANCE SYSTEMS AB, Landskrona (SE)

(72) Inventors: Peter Van De Wiel, Opperdoes (NL); Jan Balder, Heerhugowaard (NL); Sven Roos, Schoorl (NL); Johan Bizot, Heerhugowaard (NL)

(73) Assignee: Assa Abloy Entrance Systems AB, Landskrona (SE)

( * ) Notice: Subject to any disclaimer, the term of this patent is extended or adjusted under 35 U.S.C. 154(b) by 391 days.

(21) Appl. No.: 16/640,388

(22) PCT Filed: Sep. 4, 2018

(86) PCT No.: PCT/EP2018/073656
§ 371 (c)(1),
(2) Date: Feb. 20, 2020

(87) PCT Pub. No.: WO2019/048392
PCT Pub. Date: Mar. 14, 2019

(65) Prior Publication Data

US 2020/0362615 A1 Nov. 19, 2020

(30) Foreign Application Priority Data

Sep. 6, 2017 (SE) ..... 1730238-1

(51) Int. Cl.
*E05F 11/02* (2006.01)
*E05F 15/67* (2015.01)
*E05D 15/22* (2006.01)

(52) U.S. Cl.
CPC ..... *E05F 15/67* (2015.01); *E05D 15/22* (2013.01); *E05D 2015/225* (2013.01);
(Continued)

(58) Field of Classification Search
CPC ..... E05F 15/67; E05F 15/668; E05D 15/22; E05D 2015/225; E05Y 2201/412;
(Continued)

(56) References Cited

U.S. PATENT DOCUMENTS 706,626 A * 8/1902 Wood ..... E06B 7/32 160/195
2,264,643 A 12/1941 Rowe
(Continued)

FOREIGN PATENT DOCUMENTS

DE 102006016961 10/2007
EP 0410956 1/1991
(Continued)

OTHER PUBLICATIONS

International Search Report and Written Opinion mailed in PCT/EP2018/073656 dated Nov. 22, 2018.
(Continued)

*Primary Examiner* — Jerry E Redman
(74) *Attorney, Agent, or Firm* — Wissing Miller LLP

(57) ABSTRACT

The present invention relates to a door operator system (1) for opening and closing an opening (2), comprising a drive unit (10), a door frame (3) and a door (8), wherein the drive unit (10) is mounted to the door (8) and adapted to move the door (8) between an open (O) and closed position (C), the door frame (3) comprise at least a first frame section (4) adapted to be mounted at a first side (5) of the opening (2), a second frame section (6) adapted to be mounted at a second side (7) of the opening (2), a first track unit (31) moveably connected to the first frame section (4), and a second track unit (32) moveably connected to the second frame section (6), the door (8) is at a first side moveably connected to the first track unit (31) and at a second side moveably connected to the second track unit (32), wherein
(Continued)

the door frame (3) is adapted to move the door (8) between the closed position (C) and an intermediate position (I) and to guide the door (8) between the intermediate position (I) and the open position (O).

18 Claims, 6 Drawing Sheets

(52) U.S. Cl.
CPC ..... *E05Y 2201/412* (2013.01); *E05Y 2201/43* (2013.01); *E05Y 2201/624* (2013.01); *E05Y 2201/684* (2013.01); *E05Y 2600/13* (2013.01)

(58) Field of Classification Search
CPC ..... E05Y 2201/43; E05Y 2201/624; E05Y 2201/684; E05Y 2600/13; E05Y 2600/46; E05Y 2900/106; E05Y 2900/11
USPC ..... 49/202, 358
See application file for complete search history.

(56) References Cited

U.S. PATENT DOCUMENTS

| | | | | |
|---|---|---|---|---|
| 2,323,807 | A * | 7/1943 | Ferris | E05D 13/1223 160/209 |
| 5,277,240 | A * | 1/1994 | Epema | E05D 15/24 160/209 |
| 5,341,597 | A | 8/1994 | Stoltenberg | |
| 7,600,551 | B2 | 10/2009 | Lussier | |
| 9,593,525 | B1 * | 3/2017 | Morris | E05D 15/262 |
| 2005/0072537 | A1 | 4/2005 | Pfender | |
| 2022/0127887 | A1 * | 4/2022 | MacDonald | E06B 1/522 |

FOREIGN PATENT DOCUMENTS

| | | | | |
|---|---|---|---|---|
| EP | 1584778 | | 10/2005 | |
| EP | 3138983 | A1 * | 3/2017 | E05D 15/262 |
| GB | 2170553 | A * | 8/1986 | E05F 15/67 |
| GB | 2172041 | A * | 9/1986 | E05D 13/1215 |
| GB | 2227280 | | 7/1990 | |
| GB | 2308860 | A * | 7/1997 | E05D 15/38 |
| GB | 2396658 | | 6/2004 | |
| GB | 2446808 | A * | 8/2008 | E05D 13/003 |
| WO | 2018005929 | | 1/2018 | |

OTHER PUBLICATIONS

Swedish Search Report mailed in SE 1730238-1 dated Mar. 28, 2018.

* cited by examiner

DOOR OPERATOR SYSTEM

This application is a 371 of PCT/EP2018/073656 filed on Sep. 4, 2018, published on Mar. 14, 2019 under publication number WO 2019/048392, which claims priority benefits from Swedish Patent Application No. 1730238-1 filed on Sep. 6, 2017, the disclosure of which is incorporated herein by reference.

FIELD OF THE INVENTION

The present invention relates to a door operator system for opening and closing an opening.

BACKGROUND OF THE INVENTION

A door operator system for a sectional door typically comprises a door connected to a door frame and a drive unit mounted on the door frame and arranged to move the door along the door frame between an open and closed position for opening and closing the opening. A sectional door is typically used as garage doors or as an industrial door. The drive unit could comprise a motor or a mechanical unit such as a spring to move the door.

There is a need for a more efficient closure between the door and the door frame to reduce the energy costs and to reduce the leakage of air between the door and the door frame. Further, there is a need for a more efficient door operator system that reduces the complexity and the risks of the door operator system during operation, maintenance and installation.

SUMMARY OF THE INVENTION

An object of the present disclosure is to provide a door operator system which seeks to mitigate, alleviate, or eliminate one or more of the above-identified deficiencies in the art and disadvantages singly or in any combination.

An object of the present invention is to reduce the complexity of the door operator system.

An object of the present invention is to reduce or eliminate the need to have a balancing system in the door operator system, this will reduce the complexity and the risks of the door operator system since it reduces or eliminates the need of springs and cables and spring breaks and cable breaks.

A further object of the present invention is to obtain a tighter seal between the door and the door frame and at the same time not limit how the door could be moved from its open position to its closed position.

In this disclosure, a solution to the problem outlined above is proposed. In the proposed solution, a door operator system for opening and closing an opening is disclosed. The door operator system comprise a drive unit, a door frame and a door, wherein the drive unit is mounted to the door and adapted to move the door between an open and closed position, the door frame comprise at least a first frame section adapted to be mounted at a first side of the opening, a second frame section adapted to be mounted at a second side of the opening, a first track unit moveably connected to the first frame section, and a second track unit moveably connected to the second frame section, the door is at a first side moveably connected to the first track unit and at a second side moveably connected to the second track unit, wherein the door frame is adapted to move the door between the closed position and an intermediate position and to guide the door between the intermediate position and the open position.

By using the door operator system according to the above a door operator is achieved that improves the seal between the door and the door frame. Further, the improved seal reduces the energy consumption of the door operator system, both in the system itself and in the place that it is installed. The improved seal reduces the risk of that particles is transferred from one side of the door to the other side.

According to an aspect the drive unit is adapted to interact with the first and the second track unit to move the door from the intermediate position to the closed position.

According to an aspect the first and second track unit is adapted to interact with the door to move the door from the closed position to the intermediate position.

According to an aspect the drive unit is connected to the first and second track unit.

According to an aspect the drive unit is adapted to move the first and second track unit upwards to move the door between the intermediate position and the closed position.

According to an aspect the first and the second track unit is adapted to be angled in relation to the first and second frame sections when moving the door between the intermediate position and the closed position.

According to an aspect the drive unit and first and second track unit is adapted to move the door towards the first and second frame section when moving the door between the intermediate position and the closed position.

According to an aspect the drive unit and the first and second track unit is adapted to press the door towards the first and second frame section when the door is in the closed position. By pressing the door towards the first and second track unit an even further improved seal could be obtained.

According to an aspect the door operator system comprise a seal connected to the door and/or the door frame and arranged to seal the door and the frame in the closed position of the door. By using a seal in the position where the door and door frame meet an even further improved seal could be obtained.

According to an aspect the drive unit is mounted on the door.

According to an aspect the door is a sectional door comprising a plurality of horizontal and interconnected sections.

According to an aspect the door is a single blade door.

According to an aspect the first and second track unit comprise a guide track arranged to interact with at least a first respectively a second wheel of the drive unit.

According to an aspect the drive unit comprise at least a pinion and the first and the second track unit comprise a rack arranged to interact with said at least one pinion to move the door.

According to an aspect the first and the second track unit is adapted to be arranged in a first position in which the door is in the closed position and in a second position in which the door is moveable between the intermediate position and the open position.

According to an aspect the door frame comprise at least two arms, wherein one arm in a first end is rotatable connected to the first frame section and in an second end is rotatable connected to the first track unit and one arm in a first end is rotatable connected to the second frame section and in an second end is rotatable connected to the second track unit.

According to an aspect the at least two arms are arranged to guide the first and the second track units when they are moved from the first position to the second position.

According to an aspect the first and second track unit is adapted to, in the first position, be arranged substantially parallel to the first and second frame sections and, in the second position, be arranged at an angle in view of the first and second frame sections.

According to an aspect a door frame, wherein the door frame is according to the door frame in any of the above aspects.

Generally, all terms used in the claims are to be interpreted according to their ordinary meaning in the technical field, unless explicitly defined otherwise herein. All references to "a/an/the [element, device, component, means, etc.]" are to be interpreted openly as referring to at least one instance of said element, device, component, means, etc., unless explicitly stated otherwise. Further, by the term "comprising" it is meant "comprising but not limited to" throughout the application.

BRIEF DESCRIPTION OF THE DRAWINGS

The foregoing will be apparent from the following more particular description of the example embodiments, as illustrated in the accompanying drawings in which like reference characters refer to the same parts throughout the different views. The drawings are not necessarily to scale, emphasis instead being placed upon illustrating the example embodiments.

DETAILED DESCRIPTION

Figure 1:
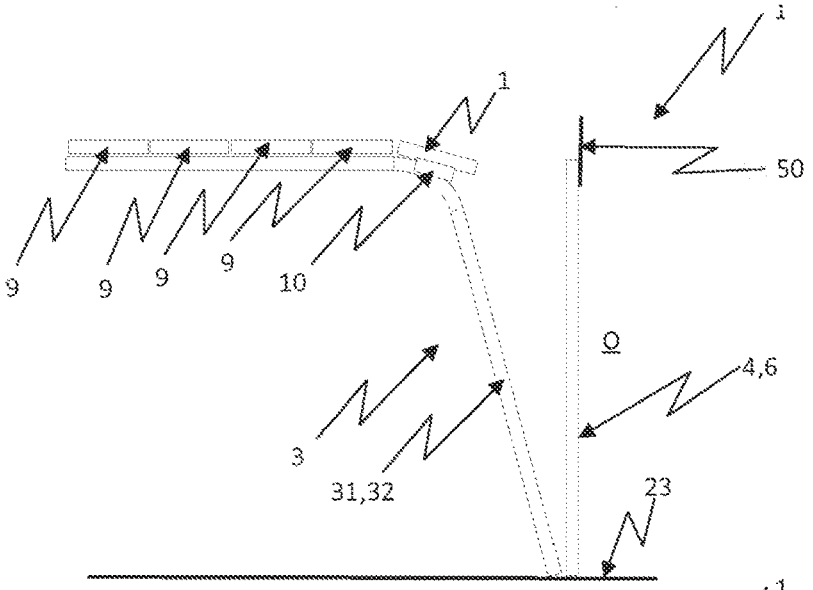
FIG. 1 discloses a schematic side view of a door operator system in an open position and comprising a sectional door.

Aspects of the present disclosure will be described more fully hereinafter with reference to the accompanying figures. The assembly disclosed herein can, however, be realized in many different forms and should not be construed as being limited to the aspects set forth herein.

The terminology used herein is for the purpose of describing particular aspects of the disclosure only, and is not intended to limit the disclosure. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

The present invention relates to door operators systems for opening and closing an opening. According to an aspect the door operator system is a sectional door operator system. According to an aspect the door operator system is door with a single blade door operator system.

A door operator system 1, disclosed in FIGS. 1-3 and 12-13, to which now is referred to, comprise a door frame 3, a drive unit 10 and a door 8. The door operator system 1 is arranged to be installed in an opening 2 defined by a wall 50 and a floor 23. The door operator system 1 is arranged to open and close the opening 2 by moving the door 8 between an open position O, as disclosed in FIGS. 1 and 13, and a closed position C, as disclosed in FIGS. 3 and 12.

According to an aspect the door operator system is an up and over door operator system. A up and over door operator system is a system in which the door in the closed position C is arranged substantially vertical and in the open position O is arranged substantially horizontal and inside of the opening.

According to an aspect the door operator system is an up and up door operator system. A up and up door operator system is a system in which the door in the closed position C is arranged substantially vertical and in the open position O is arranged substantially vertical above the opening.

According to an aspect the door is a garage door. According to an aspect the door is an industrial door.

According to an aspect, as disclosed in FIGS. 1-3 and 12, the door operator system 1 is a sectional door operator system 1. The sectional door system 1 comprises the door 8, the drive unit 10, the door frame 3, a first charging unit 13, a second charging unit 14 and a control unit 20.

The door frame 3 comprise a first frame section 4 at a first side 5 of the opening 2 and a second frame section 6 at a second side 7 of the opening 2. The door frame 3 is connected to the wall 50 and to the floor 23. The first frame section 4 comprises a substantially vertical part 4*a* and a substantially horizontal part 4*b*. The second frame section 6 comprises a substantially vertical part 6*a* and a substantially horizontal part 6*b*. The vertical part 4*a*, 6*a* and the horizontal part 4*b*, 6*b* are connected to create a path for the door 8 to glide on and a track for the drive unit 10 to interact with.

The door 8 is connected to the door frame 3.

The door 8 is a sectional door 8 comprising a plurality of horizontal and interconnected sections 9 connected to the door frame 3.

The door 8 is at a first side moveably connected to the first frame section 4 and at a second side moveably connected to the second frame section 6. According to an aspect one or more of the plurality of sections 9 is connected to the first frame section 4 at said first side 5 and to the second frame section 6 at said second side 7.

The door 8 is arranged to be moved along the door frame 3 between the closed position C and the open position O.

The drive unit 10 comprise at least one motor 11 and at least one battery 12. The at least one motor is connected to the at least one battery 12. The battery 12 is arranged to power the at least one motor 11. The drive unit 10 is connected/mounted to the door 8. According to an aspect, as disclosed in FIGS. 1-5 and 9, the drive unit 10 is mounted to a first section 9, i.e. one of said plurality of sections, of the door 8. The drive unit 10 is connected to the door frame 3. The drive unit 10 is at a first side moveably connected to the first frame section 4 and at a second side moveably connected to the second frame section 6. The drive unit 10 is arranged to interact with the door frame 3 to move the sectional door 8 from the closed position C to the open position O and from the open position O to the closed position C. According to an aspect the first section 9 is the section 9 of the door 8 being closest to the floor 23 in the closed position C.

According to an aspect the drive unit 10 could comprise several motors 11 and several batteries 12, wherein the different motors 11 are connected to one or more of the sections 9 of the door 8 and the batteries 12 are connected to one or more of the sections 9 of the door 8.

According to an aspect one or more motor 11 could be connected to one battery 12. According to an aspect one or more batteries 12 could be connected to one motor 11.

The at least one motor 11 is according to an aspect configured to brake the movement of the sectional door 8 when the sectional door 8 is moved from the open position O to the closed position C. According to an aspect, the drive unit 10 comprise at least a pinion 18 connected to the at least one motor 11, as disclosed in FIG. 4-6, 10, 11. The pinion 18 is rotated by the motor 11 when the motor 11 is running. The pinion 18 rotates the motor 11 when the weight of the door 8 moves the door 8. According to an aspect, the at least one motor 11 of the drive unit 10 is configured to act as a generator 11 and to charge the at least one battery 12 when the sectional door 8 is moved from the open position O to the closed position C.

Figure 4:
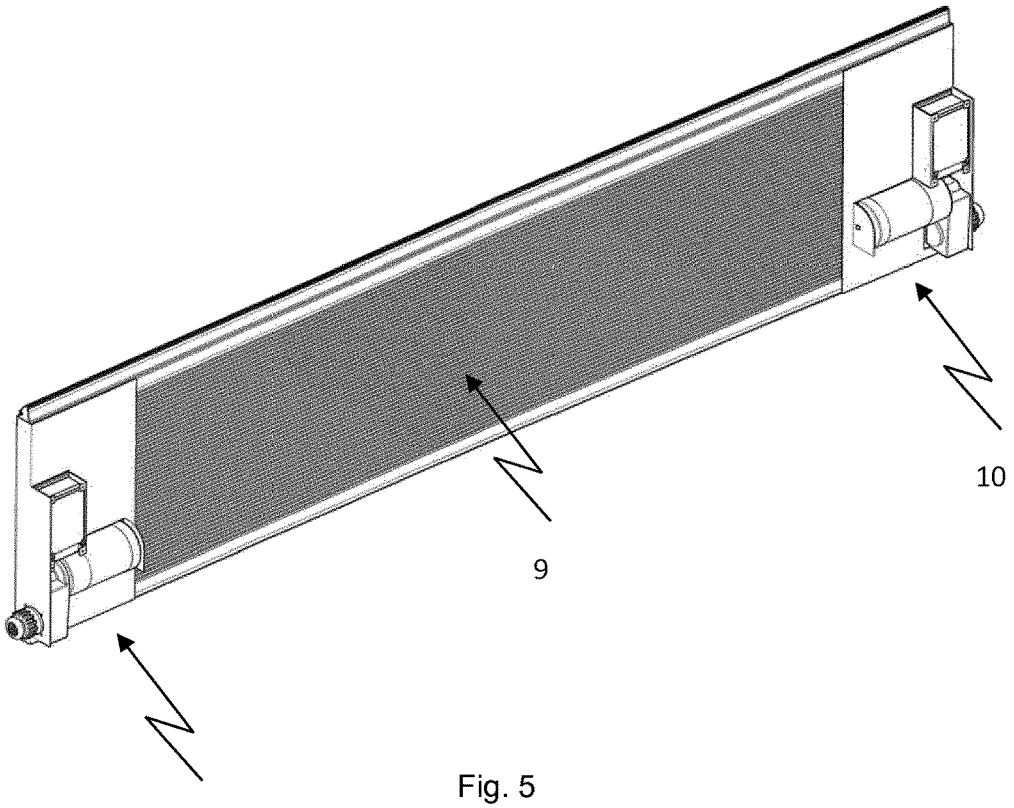
FIG. 4 discloses a schematic view of a section of a sectional door and a drive unit comprising 2 motors.
Figure 5:
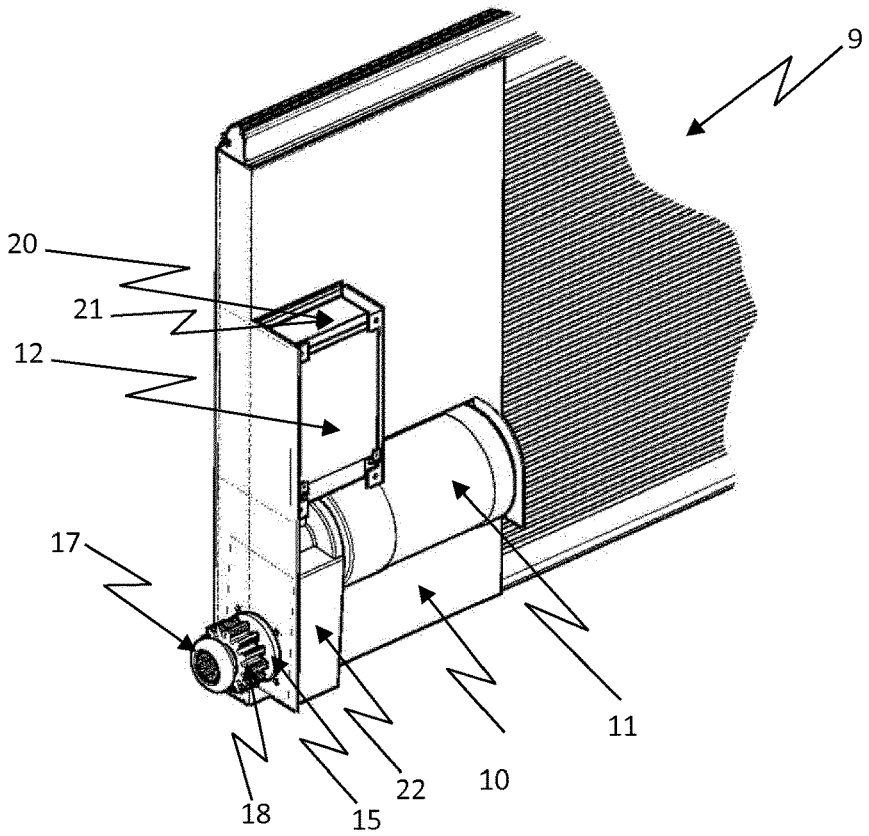
FIG. 5 discloses a schematic view of a part of the section of a sectional door and the drive unit in FIG. 4.
Figure 6:
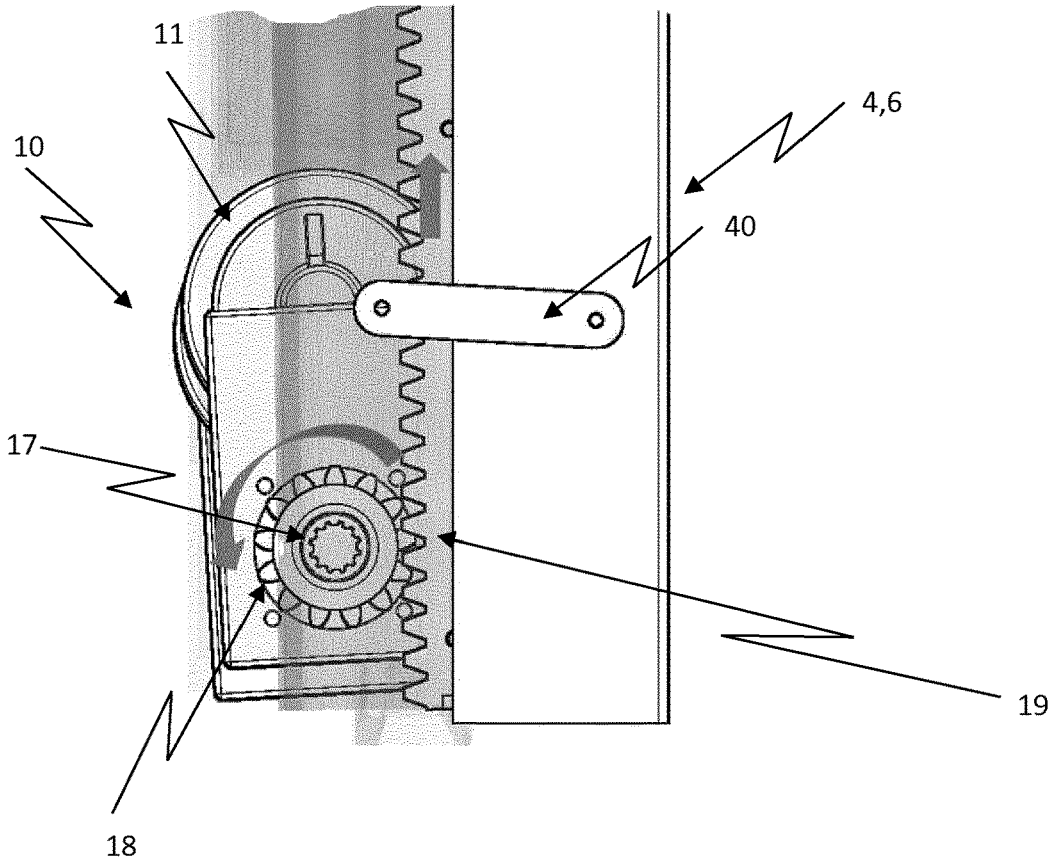
FIG. 6 discloses a schematic view the connection between the door frame and the drive unit.

According to an aspect, as disclosed in FIG. 4-6, the drive unit 10 comprise at least a first and a second wheel 17. The wheels 17 are according to an aspect connected to the motor 10. According to an aspect the wheels 17 are connected to the pinion 18 of the drive unit 10. According to an aspect the wheels 17 are arranged to be rotated by the motor 11.

Figure 8:
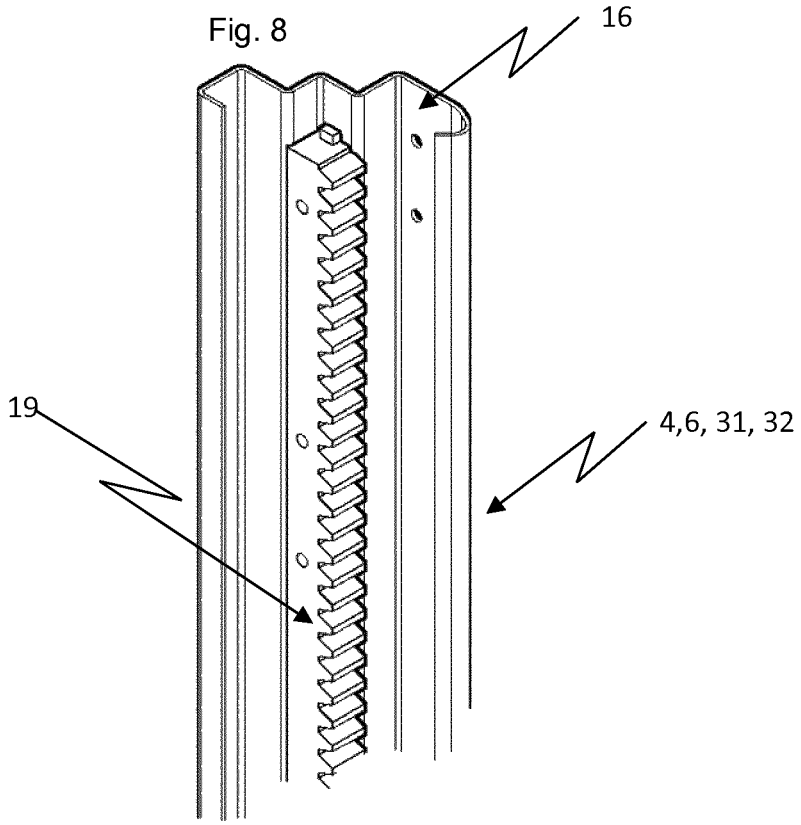
FIG. 8 discloses a schematic view of a part of the door frame.
Figure 9:
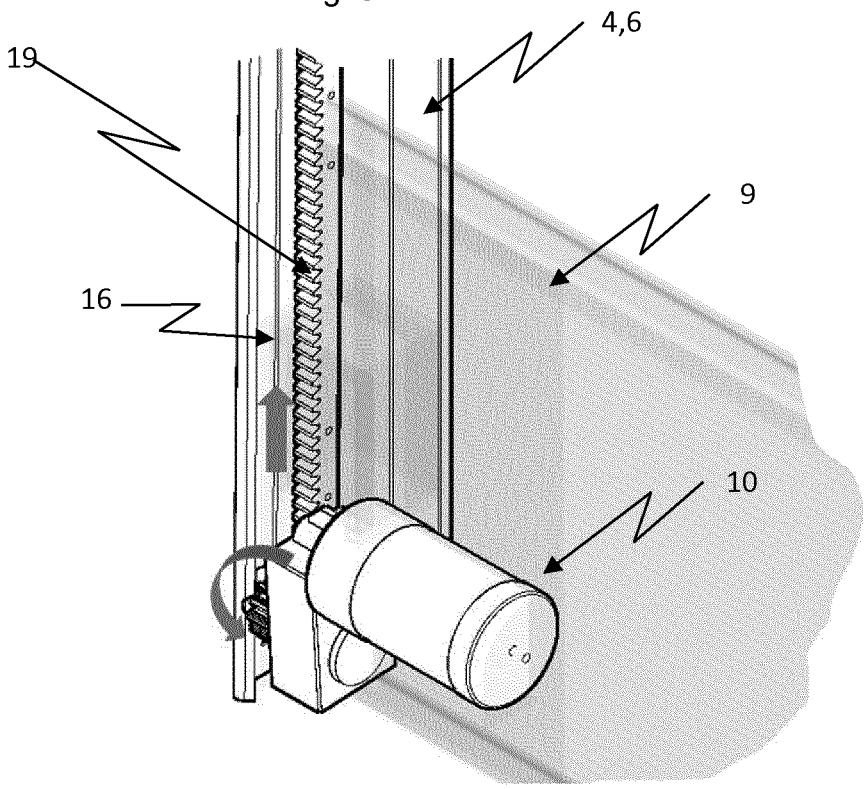
FIG. 9 discloses a schematic view of the connection between the door frame and the drive unit.
Figure 10:
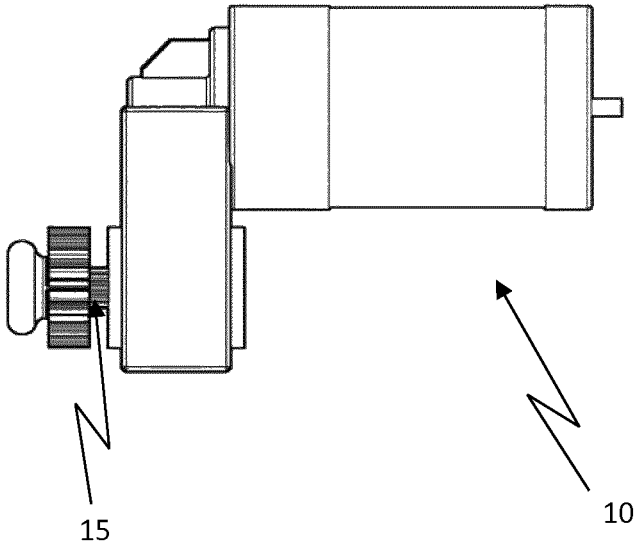
FIG. 10 discloses a schematic view of a drive unit comprising a spline joint in a compressed position.
Figure 11:
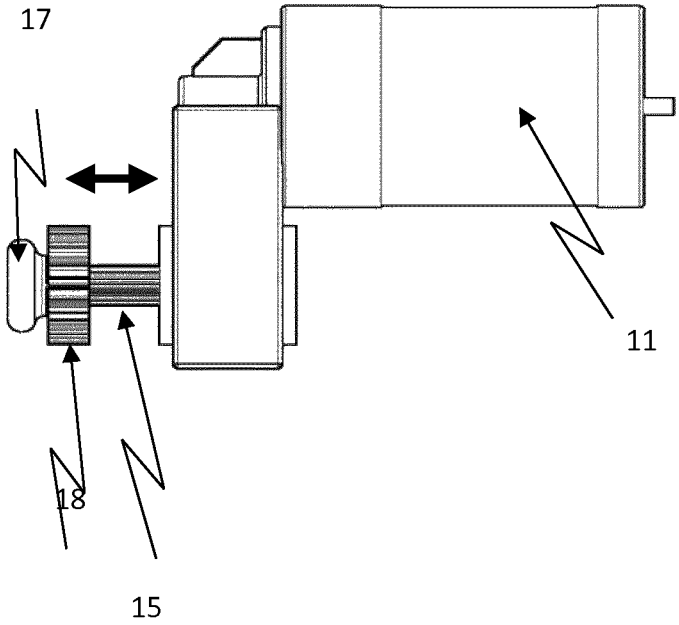
FIG. 11 discloses a schematic view of a drive unit comprising a spline joint in an extended position.

According to an aspect, as disclosed in FIG. 8, the door frame 3 comprises a guide track 16. According to an aspect the guide track 16 is connected to the first and/or second frame section 4, 6. According to an aspect the guide track 16 is an integrated part of the first and/or second frame section 4, 6. The wheel 17 is adapted to be inserted into the guide track 16. The wheel 17 is arranged to interact with the guide track 16 and to restrict horizontal movement of the wheel 17 when the wheel 17, and thus also the drive unit 10 and the door 8, is moved between the open and closed position O, C of the door 8. According to an aspect, as disclosed in FIGS. 10 and 11, the drive unit 10 comprise at least one spline joint 15. The spline joint 15 is in one end connected to one wheel 17 and in a second end connected to the motor 11. As the guide track 16 is arranged to restrict horizontal movement of the wheel 17 and the wheel is connected to the motor 11, the spline joint 15 will move and compensate for any horizontal movement of the drive unit 10 and the door 8 in relation to the door frame 3. The spline joint 15 will be compressed when the distance between the motor 11 and the door frame 3 decreases, as disclosed in 10. The spline joint 15 will be extracted when the distance between the motor 11 and the door frame increases, as disclosed in FIG. 11.

According to an aspect the spline joint 15 is arranged to compensate for horizontal movements of the at least one motor 11 in relation to the first and/or second frame section 4, 6. According to an aspect the wheels 17 are connected to the spline joint 15 of the drive unit 10.

According to an aspect, as disclosed in FIG. 6, 8, 9, the door frame 3 comprise a rack 19. According to an aspect, the first and the second frame sections (4, 6) of the door frame comprise the rack 19. The rack 19 of the door frame 3 is arranged to interact with said at least one pinion 18 of the drive unit 3 to move the door 8. The connection between the drive unit 10 and the door frame 3 is not restricted to a rack & pinion 18 connection and could be achieved by means of one or more of a belt drive, a magnetic drive or a friction drive.

The control unit 20 is connected to the drive unit 10 and arranged to control the movement of the drive unit 10, i.e. when and how the drive unit 10 should move the door 8. The control unit 20 is arranged to receive input of if the door 8 should be opened or closed. According to an aspect the control unit 20 is arranged to receive the input from one or more of a user interface, a mechanical button or a remote control. According to an aspect the control unit 20 comprise a synchronization unit 21 arranged to synchronize the movement of the at least one motor 11 such that the sections 9 of the door 8 are kept horizontal. By synchronizing the movement of the different motors 11 the sections 9 of the door 8 could be kept horizontal when moving between the open and closed position O, C.

Figure 12:
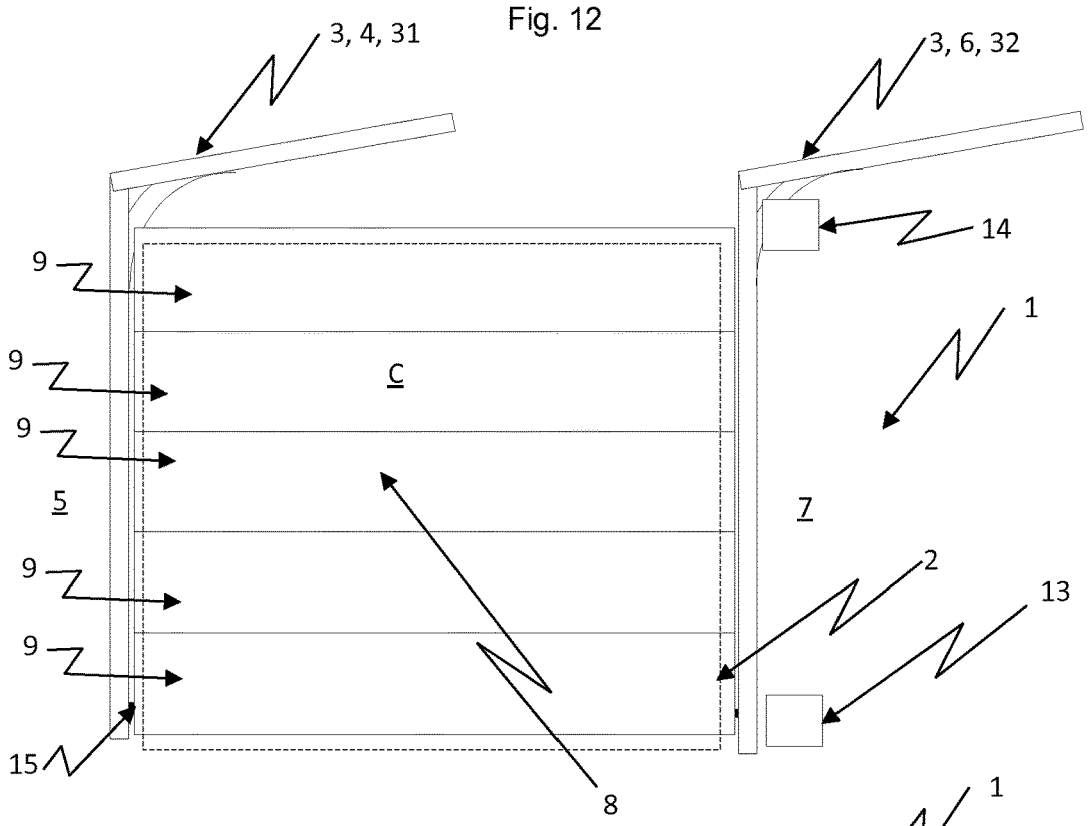
FIG. 12 discloses a schematic perspective view of a door operator system in a closed position and comprising a sectional door.
Figure 13:
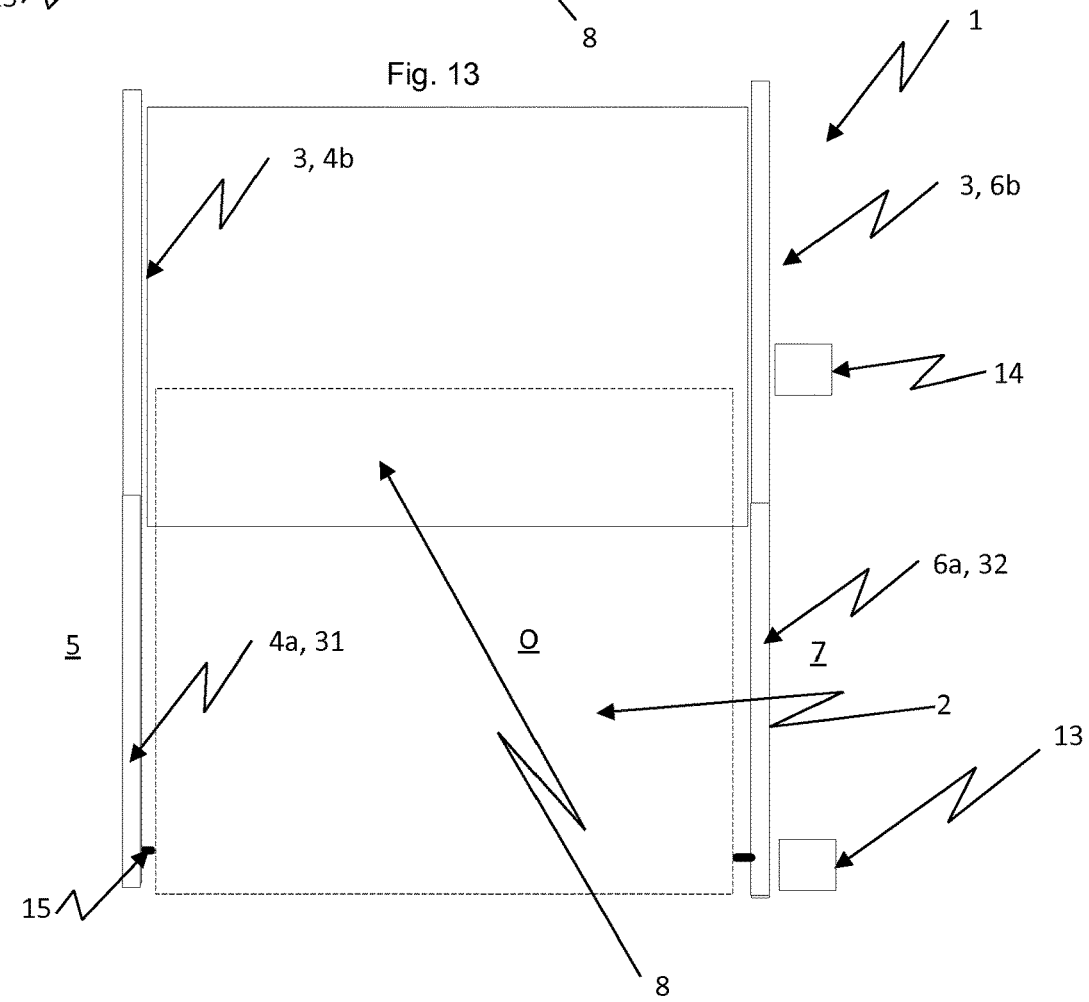
FIG. 13 discloses a schematic perspective view of a door operator system in an open position and comprising a door with a single door blade.

According to an aspect, as disclosed in FIG. 12-13, the at least a first charging unit 13 is connected to the door frame 3. The first charging unit 13 is mounted in a position that correlates with the position of the battery 12 of the drive unit 10 when the sectional door 8 is in the closed position C. The first charging unit 13 is arranged to be connected to and to charge the at least one battery 12 in the closed position.

According to an aspect, as disclosed in FIG. 12-13, the at least a second charging unit 14 is connected to the door frame 3. The second charging unit 14 is mounted in a position that correlates with the position of the battery 12 of the drive unit 10 when the sectional door 8 is in the open position C. The second charging unit 14 is arranged to be connected to and to charge the at least one battery 12 in the open position.

According to an aspect the at least one motor 11 of the drive unit 10 is a direct current DC motor 11. The at least one motor 11 of the drive unit 10 comprise according to an aspect a brake 22. According to an aspect the brake 22 is an electromagnetic brake 22. The brake 22 is arranged to control/reduce the speed of the door 8 when it is moved from the open position O to the closed position C. The first section (9) is the section (9) of the plurality of sections 9 of the door 8 being positioned closest to a floor 23 in the closed position (C) of the door (8).

According to an aspect the drive unit 10 comprise at least a first and a second motor 11 mounted on the first section 9, as disclosed in FIG. 4. The first motor 11 is moveably connected to the first frame section 4 and the second motor 11 is moveably connected to the second frame section 6. According to an aspect the first and second motor 11 is connected to one battery 12. According to an aspect the first motor 11 is connected to one battery 12 and the second motor 11 is connected to one battery 12.

According to an aspect the drive unit 10 comprise a third and a fourth motor 11 mounted on a second horizontal section 9 of the horizontal sections and arranged to assist the first and second motors 11 when moving the sectional door 8 from the closed position C to the open position O. The third and fourth motors 11 are connected to the control unit 20 and arranged to be controlled by the control unit 20 in the same way as described above in relation to the first and second motor 11.

According to an aspect the drive unit 10 comprise a fifth and a sixth motor 11 mounted on a third horizontal section 9 of the horizontal sections 9 and arranged to assist the other motors 11 when moving the sectional door 8 from the closed position C to the open position O. The fifth and sixth motors 11 are connected to the control unit 20 and arranged to be controlled by the control unit 20 in the same way as described above in relation to the first and second motor 11.

According to an aspect the drive unit 10 comprise one or more sensors (not disclosed) arranged to identify a person or object in the path of the door 8 and to interrupt or reverse the movement of the door 8 when identifying the person or object. The one or more sensors is according to an aspect one or more of a pressure sensor, a IR-sensor, a camera, a radar or a presence sensor.

Hereafter the method of how the sectional door operator system 1 opens and closes the opening 2 will be described.

In the closed position C the door 8 is positioned in the opening 2 and the opening is closed. In the closed position C the first charging unit 13 charges the one or more batteries 12 of the drive unit 10. When the control unit 20 receives input of that the door 8 should be moved from the closed position C to the open position O, the control unit 20 controls the drive unit 10 to start. The input could be from a remote control or by pressing a activation button of the door operator system 1. The battery 12 powers the drive unit 10 to drive the one or more motors 11 that are mounted to the section 9 of the door 8 and connected to the door frame 3. The motor 11 rotates the pinion 18. The pinion 18 rotates and interacts with the rack 19 and the drive unit 10 and the door 8 is moved upwards, see arrows in FIG. 9. As the drive unit 10 moves the door 8 upwards, the door 8 moves in the first and second frame section 4, 6. The first and second frame section 4, 6 guides the movement of the door 8 to guide the door 8 from the closed position C to the open position O. According to an aspect the door 8 could be horizontal, or at least at an angle in view of the closed position C, and the door 8 is positioned inside of the opening 2 and above the opening 2. When moving from the closed position C to the open position O, the sections 9 of the door that are interconnected will push on each other such that the whole door 8 will move upwards. The sections 9 will rotate and move in relation to each other when moving from a vertical position to the horizontal position. The control unit 10 will control the drive unit 10 to stop when the door 8 is positioned in the open position O. In the open position O the one or more battery 12 is connected to the second charging unit 14 and the second charging unit 14 charges the one or more battery 12. In the open position O the drive unit 10 breaks the door 8 to restrict any movement of the door 8. According to an aspect this is achieved by the motor 11 acting as a generator 11 to restrict movement between the pinion 18 and rack 19 and/or the break 22 is activated. The control unit 10 thereafter receives input, either as a signal or after a predetermined time after opening, of that the door 8 should be moved to the closed position C. The break 22 is released and/or the battery 12 drives the motor 11 to start moving the door 8. According to an aspect, the sectional door operator system uses the gravity acting on the door 8 to move the door 8 from the open position O towards the closed position C. The sections 9 of the door 8 glide in the first and second frame section 4, 6 of the door frame 3. The rack 19 interacts with the pinion 18 and rotates the pinion 18 as the door 8 and the drive unit 10 is moved downwards. According to an aspect the one or more motor 11 is run as a generator 11 when moving the door 8 from the open position O to the closed position C. As the pinion 18 is rotated the generator 11 is rotated. The generator 11 reduces the speed of the door 8. The generator 11 that is connected to the one or more battery 12 charges the one or more battery when moved by the pinion 18 and rack 19 interactions. By using the kinetic energy of the moving door 8 the battery 12 is charged. The charged energy could thereafter be stored in the battery 12 and be used for moving the door 8 from the closed position C to the open position O even if there is a power outage and the first charging unit 13 is not able to charge the battery 12. This also reduces the energy needed to operate the sectional door operator system 1. If the one or more sensors identify a person or an object in the path of the door 8, the sensors will send a signal to the control unit 20 that will control the door 8 and stop the movement of the door 8. The control unit 20 thereafter controls the door 8 to return to the open position O or to hold until the person or object has moved and control the door to continue to the closed position. As the door 8 moves towards the floor 23 it reaches the closed position C. In the closed position C the battery 12 of the drive unit will be connected to the first charging unit 13 and the battery 12 will be charged.

According to an aspect the control unit 20 will control the drive unit 10 to start when the door 8 makes contact with the floor 23 and press the door 8 downwards. By pressing the door 8 downwards a tighter seal between the door 8 and the floor 23 could be obtained to reduce the energy leakage of the sectional door operator system. A tighter seal between the door 8 and the floor 23 also reduces the risk of that particles are from one side of the door 8 to the other side. The position of the drive unit 10 on the door 8 and the interaction with the door frame 3 makes it possible to press the door 8 downwards.

Hereafter a further aspect of the invention will be described and only aspects that are different from the above will be described. The aspect could be used in any type of combination with the above identified aspects. According to an aspect the door frame 3 further comprise a first track unit 31 moveably connected to the first frame section 4, and a second track unit 32 moveably connected to the second frame section 6. The door 8 is connected to the first track unit 31 at said first side 5 and to the second track unit at said second side 7. According to an aspect the first track unit 31 is moveably connected to the vertical part **4*a* of the first frame section 4 and the second track unit 32 is moveably connected to the vertical part 6*a* of the second frame section 6**.

According to an aspect the first and the second track unit 31, 32 is adapted to be angled in relation to the first and second frame sections 4, 6. According to an aspect the first and the second track unit 31, 32 is adapted to be angled in relation to the vertical part **4*a*, 6*a* of the first and second frame sections 4, 6**.

Figure 2:
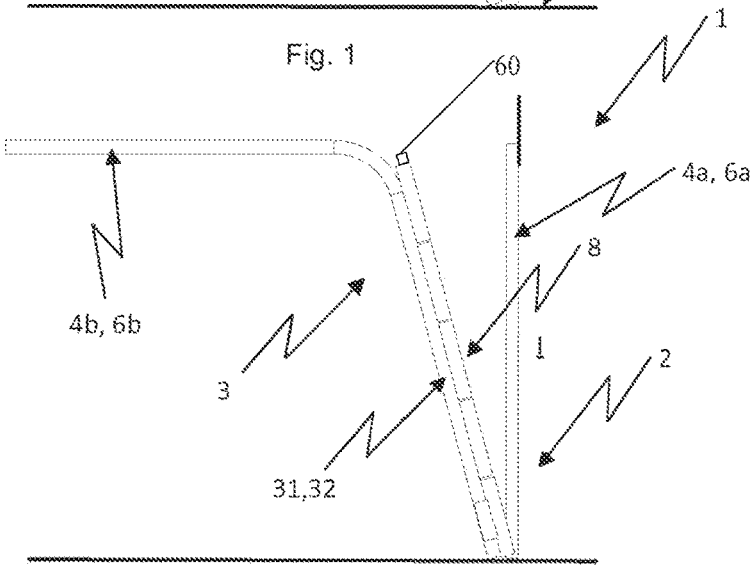
FIG. 2 discloses a schematic side view of a door operator system in an intermediate position and comprising a sectional door.
Figure 3:
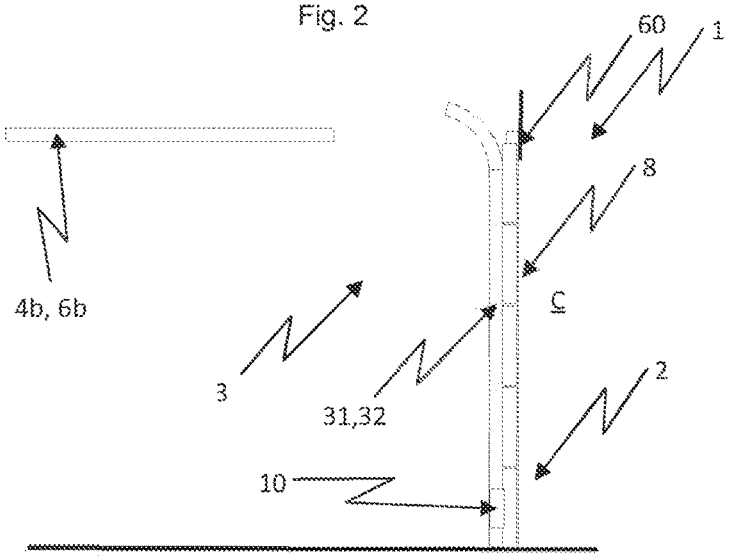
FIG. 3 discloses a schematic side view of a door operator system in a closed position and comprising a sectional door.

According to an aspect the door 8 is moveable between the closed position C, as disclosed in FIG. 3, an intermediate position I, as disclosed in FIG. 2, and the open position O, as disclosed in FIG. 1.

According to an aspect the first and the second track unit 31, 32 is adapted to be arranged in a first position in which the door 8 is in the closed position C and in a second position in which the door 8 is moveable between the intermediate position I and the open position O. Put in another way, the first and the second track unit 31, 32 is moveable between the first position, disclosed in FIG. 3, and the second position, disclosed in FIGS. 1 and 2. The horizontal part **4*b*, 6*b* of the door frame 3 are in the second position connected to the first and second track unit 31, 32 to create a path for the door 8 to glide on and a track for the drive unit 10 to interact with the door frame 3. In the second position the door 8 is moveable along the door frame 3 and glides in the first and second track units 31, 32 and the first and second frame section 4, 6. In the second position, the first and second track units 31, 32 are connected to the parts of the first and second frame sections 4, 6 at which the door 8 is positioned in the opened position O. In the second position the first track unit 31 is connected with the horizontal part 4***b* of the first frame section 4 and the second track unit 32 is connected with the horizontal part 6*b* of the second frame section 6 to achieve a path for the door 8 to be moved along and the drive unit 10 to interact with.

According to an aspect the door 8 is at a first side 5 moveably connected to the first track unit 31 and at a second side 7 moveably connected to the second track unit 32.

According to an aspect the drive unit 10 is adapted to interact with the first and the second track unit 31, 32 to move the door 8 from the intermediate position I to the closed position C.

According to an aspect the first and second track unit 31, 32 is adapted to interact with the door 8 to move the door 8 from the closed position C to the intermediate position I. According to an aspect the door 8 is moved by gravity from the closed position C to the intermediate position I.

According to an aspect the first and the second track unit 31, 32 is angled in relation to the vertical parts of the first and second frame sections 4, 6 when moving the door 8 between the intermediate position I and the closed position C.

According to an aspect the drive unit 10 moves the first and second track unit 31, 32 upwards to move the door 8 between the intermediate position I and the closed position C.

According to an aspect the drive unit 10 and first and second track unit 31, 32 moves the door 8 towards the first and second frame section 4, 6 when moving the door 8 between the intermediate position I and the closed position C.

According to an aspect the drive unit 10 and the first and second track unit 31, 32 press the door 8 towards the first and second frame section 4, 6 when the door 8 is in the closed position C.

According to an aspect the first and second track units 31, 32 is in the first position arranged substantially parallel to the vertical parts 4*a*, 6*a* of the first and second frame sections 4, 6. According to an aspect the first and second track units 31, 32 is in the second position at an angle in view of the first and second frame sections 4, 6.

Figure 7:
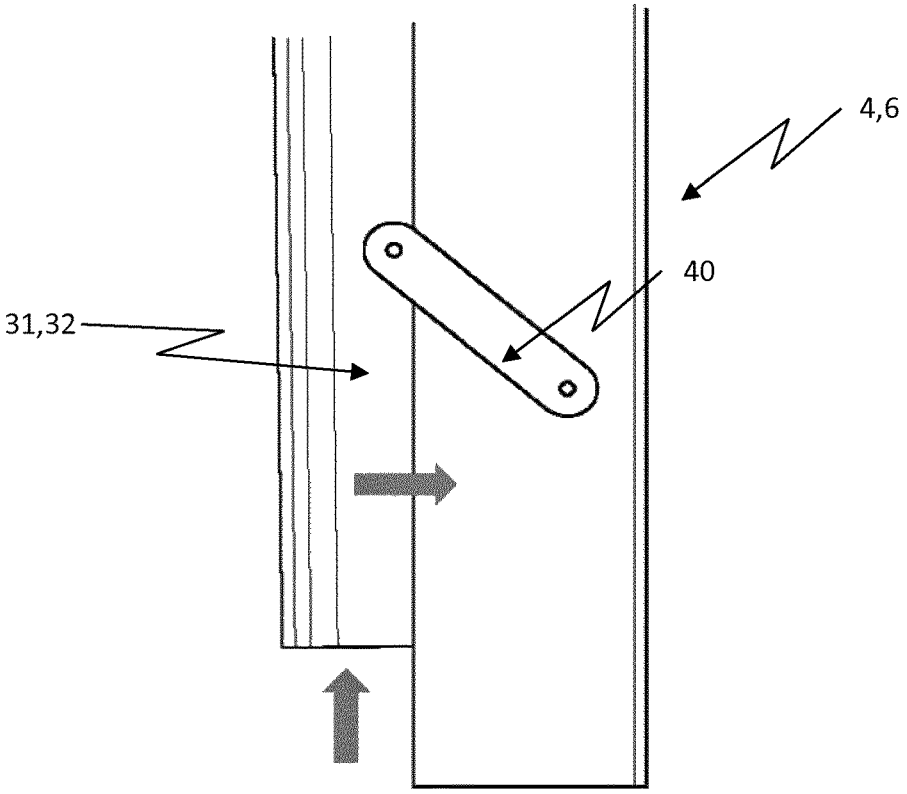
FIG. 7 discloses a schematic view of a part of the door frame.

The door frame 3 comprises at least two arms 40 as disclosed in FIGS. 6 and 7. One arm 40 is in a first end rotatable connected to the first frame section 4 and in an second end is rotatable connected to the first track unit 31 and one arm 40 in a first end is rotatable connected to the second frame section 6 and in an second end is rotatable connected to the second track unit 32. The at least two arms 40 are arranged to guide the first and the second track units 31, 32 when they are moved from the first position to the second position.

According to an aspect, the door 8 is at a first side 5 moveably connected to the first track unit 31 and at a second side 7 moveably connected to the second track unit 32.

According to an aspect the first and second track unit 31, 32 comprise the guide track 16 in accordance with above. The guide track 16 is arranged to interact with the at least first respectively second wheel 17 of the drive unit 10.

According to an aspect the door 8 is at a first side moveably connected to the first track unit 31 and at a second side moveably connected to the second track unit 32. According to an aspect one or more of the plurality of sections is connected to the first track unit 31 at said first side 5 and to the second track unit 32 at said second side 7.

According to an aspect, as disclosed in FIG. 6, 8, 9, the door frame 3 comprise a rack 19. According to an aspect, the first and the second track units 31, 32 of the door frame 3 comprise the rack 19. The rack 19 is arranged to interact with said at least one pinion 18 of the drive unit 10 to move the sectional door 8. The connection between the drive unit 10 and the door frame 3 is not restricted to a rack 19 and a pinion 18 connection and could be achieved by means of one or more of a belt drive, a magnetic drive or a friction drive.

The door frame 3 is adapted to move the door 8 between the closed position C and an intermediate position I and to guide the door 8 between the intermediate position I and the open position O as disclosed in FIG. 1-3.

The door 8 is a sectional door 8 comprising a plurality of horizontal and interconnected sections 9 connected to the door frame 3. According to an aspect the door 8 is a single blade door 8.

According to an aspect the door operator system 1 comprise one or more sensors (not disclosed) arranged to identify a person or object in the path of the door 8 and/or the moving door frame 3 and to interrupt or reverse the movement of the door 8 and/or the door frame 3 when identifying the person or object. The one or more sensors are according to an aspect one or more of a pressure sensor, an IR-sensor, a camera, a radar or a presence sensor.

Hereafter the method of how the sectional door operator system 1 opens and closes the opening 2 by moving the door 8 between the closed position C, intermediate position I and open position O will be described.

In the closed position of the door 8, door 8 is positioned in the opening 2 and the opening is closed. In the closed position the first and second track units 31, 32 is in their first position. In the closed position C the first charging unit 13 charges the one or more batteries 12 of the drive unit 10. In the closed position C the motor 11 of the drive unit 10 presses the door 8 and the first and second track units 31, 32 towards the first and second frame sections 4, 6. The door 8 could be held in the closed position by the motor 11.

As the door 8 is pressed against the door frame 3, a tight seal between them could be obtained that reduces the isolation between the two sides of the door. Further, a separate seal 60 could be connected to the door 8 and/or the door frame 3 to interact with the door 8 and the door frame 3 to further seal any gap. In the closed position C the drive unit 10 breaks the door 8 to restrict any movement of the door 8. According to an aspect this is achieved by the motor 11 acting as a generator 11 to restrict movement between the pinion 18 and rack 19 and/or the break 22 is activated.

When the control unit 20 receives input of that the door 8 should be opened it controls the drive unit 10 to release the break 22 and/or stop acting as a generator 11. This will reduce/take away the force that the drive unit 10 presses the door 8 against the door frame 3 with. The gravity of the weight of the door 8 and the first and second track units 31, 32 that is connected to the door 8 will move the door 8 downwards and at the same time angle/rotate the door 8 and the first and second track units 31, 32 in view of the vertical parts 4*a*, 6*a* of the first and second frame units 4, 6. The movement of the door 8 and the first and second track units 31, 32 in view of the vertical parts of the first and second frame units 4, 6 is controlled and guided by the at least two arms 40. The first and second track units 31, 32 are now positioned in their second position and the door 8 is positioned in the intermediate position I.

When the control unit 20 receives input of that the door 8 is in the intermediate position I and should be moved to the open position O, the control unit 20 controls the drive unit 10 to start. The battery 12 powers the drive unit 10 to drive the one or more motors 11 that are mounted to the section 9 of the door 8 and connected to the door frame 3. The motor 11 rotates the pinion 18. The pinion 18 rotates and interacts with the rack 19 of the first and second track units 31, 32 and the drive unit 10 and the door 8 is moved upwards, see arrows in FIG. 9. As the drive unit 10 moves the door 8 upwards, the door 8 moves in the first and second track units 31, 32 and after a distance move over to the horizontal part 4*b*, 6*b* of the first and second frame units 4, 6. The first and second track units 31, 32 and the horizontal part of the first and second frame section 4, 6 guides the movement of the door 8 to guide the door 8 from the intermediate position I to the open position O. According to an aspect the door 8 could be horizontal in the open position O, or at least at an angle in view of the closed position C, and the door 8 is positioned inside of the opening. When moving from the intermediate position I to the open position O, the sections 9 of the door that is interconnected will push on each other such that the whole door 8 will move upwards. The sections 9 will rotate and move in relation to each other when moving from an angled position to the horizontal position. The control unit 10 will control the drive unit 10 to stop when the door 8 is positioned in the open position O. In the open position O the one or more battery 12 is connected to the second charging unit 14 and the second charging unit 14 charges the one or more battery 12. In the open position O the drive unit 10 breaks the door 8 to restrict any movement of the door 8. According to an aspect this is achieved by the motor 11 acting as a generator 11 to restrict movement between the pinion 18 and rack 19 and/or the break 22 is activated. The control unit 10 thereafter receives input of that the door 8 should be moved to the closed position C. The break 22 is released and/or the battery 12 drives the motor 11 to start moving the door 8. According to an aspect, the sectional door operator system uses gravity to move the door 8 from the open position O towards the intermediate position I. The sections 9 of the door 8 glide in the horizontal parts 4*b*, 6*b* of the first and second frame section 4, 6 and the first and second track units 31, 32 of the door frame 3. The rack 19 interacts with the pinion 18 and rotates the pinion 18 as the door 8 and the drive unit 10 is moved downwards. According to an aspect the one or more motor 11 is run as a generator 11 when moving the door 8 from the open position O to the intermediate position I. As the pinion 18 is rotated the generator 11 is rotated. The generator 11 reduces the speed of the door 8. The generator 11 that is connected to the one or more battery 12 charges the one or more battery when moved by the pinion 18 and rack 19 interactions. By storing the kinetic energy of the door 8 in the battery 12 the battery is charged. The charged energy could thereafter be stored in the battery 12 and be used for moving the door 8 from the closed position C to the open position O even if there is a power outage and the first charging unit 13 is not able to charge the battery 12. This also reduces the energy needed to operate the sectional door operator system 1. If the one or more sensors identify a person or an object in the path of the door 8, the sensors will send a signal to the control unit 20 that will control the door 8 and stop the movement of the door 8. The control unit 20 thereafter controls the door 8 to return to the open position O or to hold until the person or object has moved and control the door to continue moving downwards. As the door 8 moves towards the floor 23 it reaches the intermediate position I. When moving the door 8 from the intermediate position I to the closed position the drive unit 10 is once again activated by the control unit 20. The battery 12 powers the motor 11 and the motor 11 presses the door 8 towards the floor 23. The rack 19 and pinion 18 connection between the drive unit 10 and the door frame 3 enables the drive unit 10 to press the door 8 towards the floor 23 and at the same time press the first and second track units 31, 32 of the door frame 3 upwards. As the first and second track units 31, 32 of the door frame 3 is movable between their second and first position, the drive unit 10 will move them upwards and move them from their second position to the first position. The door 8 is connected to the first and second track units 31, 32 of the door frame 3 and will thus move together with the first and second track units 31, 32 of the door frame 3 from the intermediate position I to the closed position C. When moving from the second position to the first position, the first and second track units 31, 32 of the door frame 3 will move upwards and be angled and disengage from the horizontal parts of the first and second frame sections 4, 6. The movement of the first and second track units 31, 32 of the door frame 3 are driven by the drive unit 10 and guided by the at least two arms 40. If the one or more sensors identify a person or an object in the path of the door 8 and/or the door frame 3 when moving from the intermediate position I to the closed position, the sensors will send a signal to the control unit 20 that will control the door 8 and stop the movement of the door 8. The control unit 20 thereafter controls the door 8 to return to the intermediate position O or to hold until the person or object has moved and control the door to continue moving towards the closed position. In the closed position the door 8 is pressed towards the floor 23 and towards the door frame 3 and/or the wall 50. The aspect of combining the movability of the door 8 between the open position O and the closed position C and at the same time enable a tight seal between the door 8 and the door frame 3 and/or wall 50 reduces the complexity of the door operator system 1 and increases the isolation of the system. The increased isolation is not only favourable from an energy perspective but also from a hygiene perspective as the possibility for particles and air through the door operator system is reduced.

According to an aspect the door frame 3 in accordance with any of the above could be installed in an existing door operator system by replacing the door frame.

According to an aspect the drive unit 10 in accordance with any of the above could be installed in an existing door operator system by replacing the drive unit.

The above aspects have been described in relation to a door operator system in which the door is vertical in the closed position C and substantially horizontal in the open position O. However, the aspects could also be used in door operator systems with other orientations of the door in the open and closed position. According to an aspect the door operator system is an up and up system, in which the door 8 is moved upwards to the open position and is not angled. According to an aspect the door 8 is moved along a straight line from the intermediate position to the open position. The door frame 3 is connected to the wall 50 and to the floor 23. The first frame section 4 comprises a substantially vertical part 4*a* and a substantially vertical part 4*b*. The second frame section 6 comprises a substantially vertical part 6*a* and a substantially vertical part 6*b*. Put in another way, the first and second frame sections 4, 6 are substantially vertical.

According to an aspect the door 8 is moved in along a straight line from the closed position to the open position.

According to an aspect the door 8 comprises one rigid door panel. Put in another way, instead of comprising several sections 9 the door 8 comprise one bigger section 9. According to an aspect the drive unit is connected to said section 9.

The person skilled in the art realizes that the present invention by no means is limited to the preferred embodiments described above. On the contrary, many modifications and variations are possible within the scope of the appended claims.

The description of the aspects of the disclosure provided herein has been presented for purposes of illustration. The description is not intended to be exhaustive or to limit aspects of the disclosure to the precise form disclosed, and modifications and variations are possible in light of the above teachings or may be acquired from practice of various alternatives to the provided aspects of the disclosure. The examples discussed herein were chosen and described in order to explain the principles and the nature of various aspects of the disclosure and its practical application to enable one skilled in the art to utilize the aspects of the disclosure in various manners and with various modifications as are suited to the particular use contemplated. The features of the aspects of the disclosure described herein may be combined in all possible combinations of methods, apparatus, modules, systems, and computer program products. It should be appreciated that the aspects of the disclosure presented herein may be practiced in any combination with each other.

It should be noted that the word "comprising" does not necessarily exclude the presence of other elements or steps than those listed. It should further be noted that any reference signs do not limit the scope of the claims.

The invention claimed is:

1. A door operator system for opening and closing an opening, comprising a drive unit, a door frame and a door, wherein the drive unit is mounted to the door and adapted to move the door between an open and closed position, the door frame comprising:

at least a first frame section adapted to be mounted at a first side of the opening, a second frame section adapted to be mounted at a second side of the opening, a first track unit moveably connected to the first frame section, and a second track unit moveably connected to the second frame section; and the door is at a first side moveably connected to the first track unit and at a second side moveably connected to the second track unit, wherein the door frame is adapted to move the door between the closed position and an intermediate position and to guide the door between the intermediate position and the open position, wherein the first and the second track units are movable between a first position and a second position, such that in the first position the door is in the closed position, and in the second position the door is moveable between the intermediate position and the open positon, wherein the frame further comprises:

a first arm with a first end rotatably connected to the first frame section and a second end rotatably connected to the first track unit; and a second arm with a first end rotatably connected to the second frame section and a second end rotatably connected to the second track unit.

2. The door operator system according to claim 1, wherein the drive unit is adapted to interact with the first and the second track unit to move the door from the intermediate position to the closed position.

3. The door operator system according to claim 1, wherein the first and second track units are adapted to interact with the door to move the door from the closed position to the intermediate position.

4. The door operator system according to claim 1, wherein the drive unit is connected to the first and second track units.

5. The door operator system (1) according to claim 1, wherein the drive unit is adapted to move the first and second track units upwards to move the door between the intermediate position and the closed position.

6. The door operator system according to claim 1, wherein the first and the second track unit are adapted to be angled in relation to the first and second frame sections when moving the door between the intermediate position and the closed position.

7. The door operator system according to claim 1, wherein the drive unit and first and second track units are adapted to move the door towards the first and second frame section when moving the door between the intermediate position and the closed position.

8. The door operator system according to claim 7, wherein the drive unit and the first and second track units adapted to press the door towards the first and second frame section when the door is in the closed position.

9. The door operator system according to claim 1, further comprising a seal connected to the door and/or the door frame and arranged to seal the door and the door frame in the closed position of the door.

10. The door operator system according to claim 1, wherein the drive unit is mounted on the door.

11. The door operator system according to claim 1, wherein the door is a sectional door comprising a plurality of horizontal and interconnected sections.

12. The door operator system according to claim 1, wherein the door is a single blade door.

13. The door operator system according to claim 1, wherein the first and second track units comprise a guide track arranged to interact with at least a first and second wheel of the drive unit.

14. The door operator system according to claim 1, wherein the drive unit comprises at least a pinion, and the first and the second track units comprise a rack arranged to interact with said at least one pinion to move the door.

15. The door operator system according to claim 1, wherein the first and second arms are arranged to guide the first and the second track units when the first and the second track units are moved from the first position to the second position.

16. The door operator system according to claim 1, wherein the first and second track units are adapted to, in the first position, be arranged substantially parallel to the first and second frame sections and, in the second position, be arranged at an angle in view of the first and second frame sections.

17. A door frame, comprising:

a first frame section configured to be mounted at a first side of a door opening and first track moveable connected to the first frame section;

a second frame section configured to be mounted at a second side of the door opening and a second track unit moveably connected to the second frame section, wherein the first and second track units moveably secure a door such that the door moves, together with the first and second track units, between the closed position and an intermediate position, and such that the door is guided along the first and second track units between the intermediate position and the open position, wherein the first and the second track units are movable between a first position and a second position, such that in the first position the door is in the closed position, and in the second position the door is moveable, together with the first and second track units, between the intermediate position and the open position, wherein the door frame comprises:

a first arm with a first end rotatably connected to the first frame section and a second end rotatably connected to the first track unit; and a second arm with a first end rotatably connected to the second frame section and a second end rotatably connected to the second track unit.

18. A door operator system for opening and closing an opening, the system comprising a drive unit, a door frame and a door, wherein the drive unit is mounted to the door and adapted to move the door between an open and a closed position, the door operator system comprising:

a stationary horizontal portion providing a horizontal path for the door to glide on;

a first frame section mountable at a first side of the opening, and a first track unit moveably connected to the first frame section;

and a second frame section mountable at a second side of the opening, and a second track unit moveably connected to the second frame section;

the door at a first side moveably connected to the first track unit and at a second side moveably connected to the second track unit;

wherein in the open position, at least a majority of the door frame rests on the horizontal path of the stationary horizontal portion, wherein in the closed position the stationary horizontal portion is disconnected from the door and from the first track and second track units.

* * * * *